US005508787A

United States Patent [19]

Hasegawa et al.

[11] Patent Number: 5,508,787

[45] Date of Patent: Apr. 16, 1996

[54] METHOD AND APPARATUS FOR CONTROLLING PROCESS CONDITION FOR IMAGE FORMATION

[75] Inventors: Shin Hasegawa, Chiba; Yasushi Koichi, Yamato, both of Japan

[73] Assignee: Ricoh Company, Ltd., Tokyo, Japan

[21] Appl. No.: 233,925

[22] Filed: Apr. 28, 1994

[30] Foreign Application Priority Data

Apr. 28, 1993 [JP] Japan ..... 5-125396

[51] Int. Cl.[6] ..... G03G 21/00

[52] U.S. Cl. ..... 355/208; 355/214

[58] Field of Search ..... 355/208, 214, 355/246

[56] References Cited

U.S. PATENT DOCUMENTS 4,616,923 10/1986 Reuter ..... 355/214 X 5,006,896 4/1991 Koichi et al. ..... 355/246

5,045,883 9/1991 Ishigaki et al. ..... 355/214

*Primary Examiner*—Robert Beatty

*Attorney, Agent, or Firm*—Oblon, Spivak, McClelland, Maier & Neustadt

[57] ABSTRACT

In an image forming apparatus, a voltage for a charger, a voltage for a light source for exposure or similar process condition for image formation is controlled such that a control parameter particular to image formation, e.g., the surface potential of an image carrier (light portion or dark portion) or the amount of toner deposited on the image carrier lies in a first predetermined tolerance width of a target value. Subsequently, the process condition is controlled such that the control parameter lies in a second predetermined tolerance width of the target value which is narrower than the first tolerance width. As a result, the control parameter is confined in the second tolerance width for achieving the final control accuracy.

19 Claims, 5 Drawing Sheets

METHOD AND APPARATUS FOR CONTROLLING PROCESS CONDITION FOR IMAGE FORMATION

BACKGROUND OF THE INVENTION

The present invention relates to a method and an apparatus for controlling a copier, facsimile apparatus, printer or similar image forming machine and, more particularly, to a method and an apparatus for adjusting a process condition for image formation on the basis of a sensed control parameter particular to image formation.

A conventional control method for the above application senses a control parameter particular to image formation, e.g., the surface potential of a latent image electrostatically formed on an image carrier (light portion or dark portion) and adjusts, based on the sensed surface potential, a charging condition, exposing condition or similar process condition for image formation. With this method, it is possible to stabilize the surface potential of the image carrier at a target value. For this kind of scheme, a reference may be made to Japanese Patent Laid-Open Publication Nos. 64-78268, 2-52368, and 3-136072 by way of example.

The conventional process condition control method has some problems left unsolved, as follows. Assume that a change in the surface potential or similar control parameter is increased for a minimum control amount of the process condition. i.e., a control resolution is lowered. Then, although a period of time necessary for the actual surface potential to approach a target potential, i.e., a control time may be reduced, the degree to which the surface potential is close to the target potential after the control. i.e., control accuracy is lowered. While a smaller change in the surface potential for the minimum control amount, i.e., a higher control resolution will enhance the control accuracy, it increases the control time. For example, a target value for control is provided with a relatively narrow tolerance width in order to enhance the control accuracy. Then, a high control resolution is required for preventing the surface potential, or control parameter, from failing to converge due to jitter when the control amount of the process condition is shifted up or shifted down in the vicinity of the target value. The high control resolution results in a long control time, as stated above.

SUMMARY OF THE INVENTION

It is therefore, an object of the present invention to provide a method and an apparatus capable of controlling a process condition for image formation rapidly and accurately.

In accordance with the present invention, a method of controlling a process condition for image formation on the basis of the sensed value of a control parameter particular to image formation comprises the steps of adjusting the process condition such that the sensed value of the control parameter lies in a first predetermined tolerance width of a target value, and subsequently adjusting the process condition such that the sensed value of the control parameter lies in a second predetermined tolerance width of the target value which is narrower than the first tolerance width.

Also, in accordance with the present invention, an apparatus for controlling a process condition for image formation comprises a sensor for sensing a control parameter particular to an image forming process, and a controller for controlling a process condition for image formation on the basis of the control parameter sensed by the sensor. The controller comprises a first controller for adjusting the process condition such that the control parameter sensed by the sensor lies in a first predetermined tolerance width of a target value, and a second controller for adjusting the process condition such that the control parameter sensed by the sensing means lies in a second predetermined tolerance width of the target value which is narrower than the first tolerance width.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENT

Figure 1:
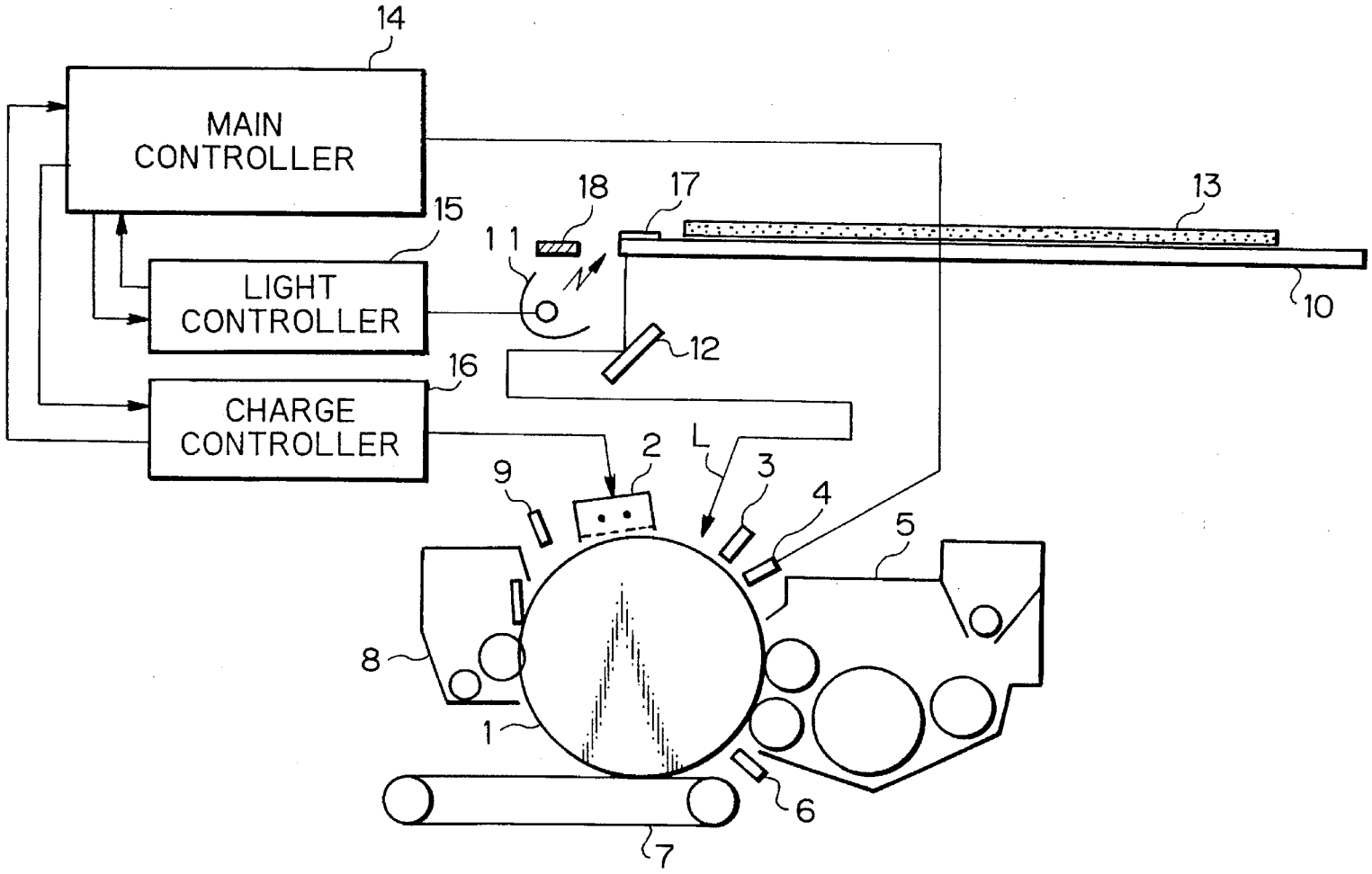
FIG. 1 schematically shows a copier representative of an embodiment of the present invention.

Referring to FIG. I of the drawings, an electrophotographic copier belonging to a family of image forming apparatuses and representative of an embodiment of the present invention is shown. As shown, the copier has a photoconductive drum 1 playing the role of an image carrier and provided with a photoconductor on the surface thereof. Arranged around the drum 1 are a charger 2, an eraser 3, a potential sensor 4, a developing unit 5, a pretransfer discharger 6, a transfer belt 7, a cleaning unit 8, a discharge lamp 9, and other conventional units. A glass platen 10 is provided on the top of the copier to be loaded with a document. Disposed below the glass platen 10 is optics for exposure which includes a lamp 11 and a mirror 12.

In operation, after a document 13 has been laid on the glass platen 10, a copy start button provided on an operation panel, not shown, is pressed. Then, the lamp 11 illuminates the document 13 while the resulting reflection, or imagewise light, L from the document 13 is focused onto the drum 1 via the mirror 12 and other constituents of the optics. The surface of the drum 1 has been uniformly charged by the charger 2 beforehand. As a result, the light L from the document 13 selectively attenuates the surface potential of the drum 1, thereby electrostatically forming a latent image on the drum 1. The eraser 3 attenuates the surface potential of the drum 1 around the image area. As the latent image is brought to the developing unit 5 by the drum 1, it is developed by the unit 5 to turn out a toner image corresponding to the document image. The pretransfer discharger 6 attenuates the surface potential of the drum 1 carrying the toner image thereon. Then, the toner image is transferred from the drum 1 to a paper or similar medium, not shown, fed to the transfer belt 7. After the image transfer, the surface of the drum 1 is cleaned by the cleaning unit 8 to remove toner particles remaining thereon. Finally, charges remaining on the drum 1 are dissipated by the discharge lamp 9 with the result that the drum 1 is prepared for the next copying cycle.

The illustrative embodiment controls process conditions for image formation such that particular control parameters included in an image forming process each lies in a predetermined range. Specifically, in the embodiment, voltages to be respectively applied to the grid electrode of the charger 2 (referred to as a grid voltage VG hereinafter) and the lamp 11 (referred to as a lamp voltage VLP hereinafter) are so adjusted as to confine each of the potentials VD and VL of the drum 1 measured in a dark portion and a light portion, respectively, in a predetermined range. To implement the two potentials VL and VD, documents 17 and 18 are fixed in place on the glass platen 10 for controlling the potentials VL and VD, respectively.

As shown in FIG. 1, control means for controlling the process conditions comprises a main controller 14 consisting of a CPU (Central Processing Unit), a RAM (Random Access Memory), a ROM (Read Only memory), an I/O (Input/Output) section and so forth, a light controller 15 for changing the lamp voltage VLP in response to a control signal from the main controller 14, and a charge controller 16 for changing the grid voltage VG of the charger 2. The surface potentials VD and VL of the drum 1 are sensed by the potential sensor 4 and then applied to and processed by the main controller 14. Target values ($VL_0$ and $VD_0$) and tolerance widths ($\Delta VL_1$, $\Delta VL_2$, $\Delta VD_1$ and $\Delta VD_2$) for the control are stored in the storage of the main controller 14. An arrangement may be made such that such target values and tolerance widths are variable, if desired.

Figure 2A:
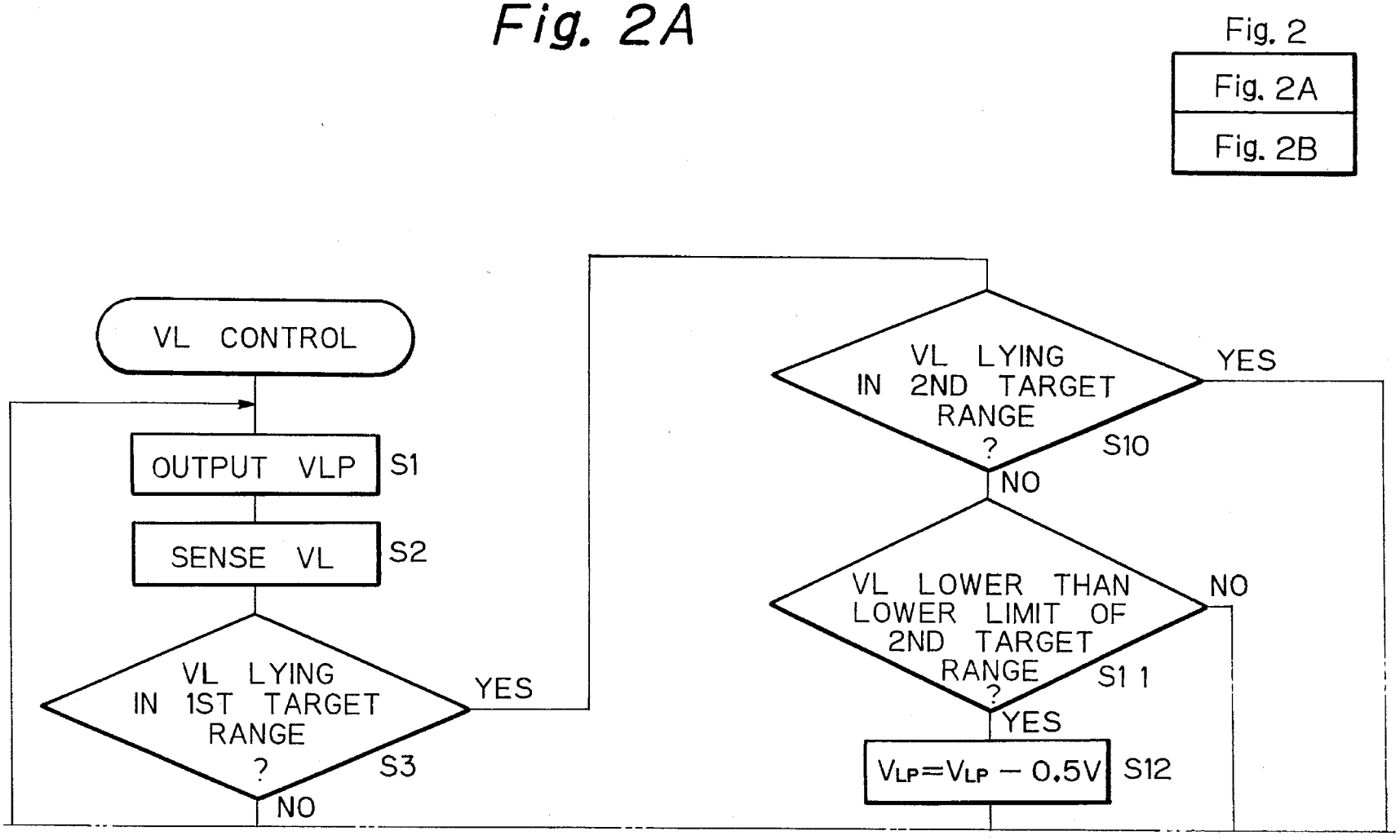
FIG. 2 is a flowchart demonstrating a specific operation of the embodiment for adjusting a lamp voltage in such a manner as to confine the potential of a light portion in a predetermined range.
Figure 2B:
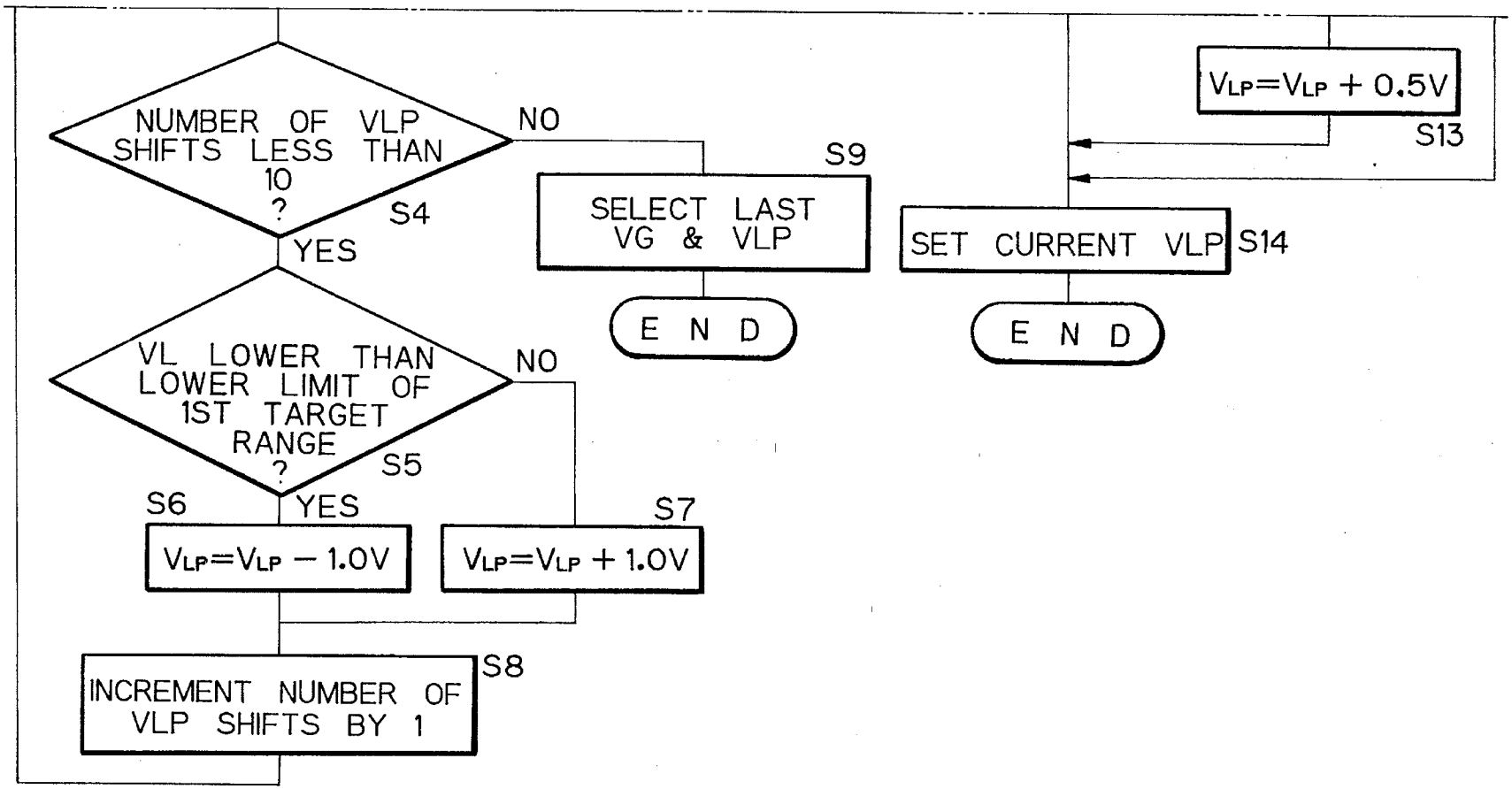

A reference will be made to FIG. 2 for describing how the lamp voltage VLP is controlled in such a manner as to confine the potential VL of a light portion in a predetermined range represented by the target value $VL_0\pm$ tolerance width $\Delta VL_2$. In a first control stage, the charger 2 and the lamp 11 are respectively turned on by the grid voltage VG and the lamp voltage VLP each having a certain value (usually, a value used for the last control). In this condition, a latent image representative of the document 17 for light portion potential control is formed on the drum 1 (step S1). The potential sensor 4 senses the potential VL of a light portion forming a part of the latent image (step S2). Then, whether or not the potential VL lies in a first target range, which is the control value $VL_0\pm$ first tolerance width $\Delta VL_1$ (200±20 V), is determined (step S3). If the answer of the step S3 is negative, N, whether or not the number of times that the lamp voltage VLP has been shifted is less than an upper limit (ten times) is determined (step S4). If the answer of the step S4 is positive, Y, whether or not the the potential VL is lower than the lower limit (180 V) of the first target range is determined (step S5). If the former is lower than the latter. (Y, step S5), the lamp voltage VLP is shifted down by 1.0 V (step S6); if otherwise, it is shifted up by 1.0 V (step S7). The updated lamp voltage VLP is stored as a new process condition. Then, the number of VLP shifts is incremented by 1 (one) (step S8), and the program returns to the step 1.

The change ΔVLP in the lamp voltage VLP and the change ΔVL in the potential VL of a light portion have a relation of ΔVL/AVLP=−30. Hence, when the lamp voltage VLP is shifted up (or shifted down) by 1.0 V, the potential VL decreases (or increases) by 30 V. Specifically, the control resolution is 30 V which is great enough to confine the potential VL in the first target range in a short time and is lower than the first tolerance width $\Delta VL_1$ (±20=40 V) to eliminate jitter.

The above-stated control loop is repeated thereafter. When the number of shifts of the lamp voltage VLP exceeds ten times (N, step $4), it is determined that an error has occurred in the VL control. Then, the process conditions (VG and VLP) used for the last control are used as they are (step 9).

When the potential VL sensed by the potential sensor 4 lies in the first target range (Y, step $3), the program enters into a second control stage. Specifically, whether or not the potential VL lies in a second target range, which is the target value $VL_0\pm$ second tolerance width $\Delta VL_2$ (200±10 V), is determined (step S10). If the answer of the step S10 is positive, the lamp voltage VLP applied this time is used as a process condition (step S14), if the answer of the step S10 is negative, N, whether or not the potential VL is lower than the lower limit (190 V) of the second target range is determined (step S11). If the former is lower than the latter (Y, step S11), the lamp voltage VLP is shifted down by 0.5 V (step S12): if otherwise, it is shifted up by 0.5 V (step S13). The updated lamp voltage VLP is used as a new process condition.

From the relation ΔVE/ΔVLP=−30, it follows that when the lamp voltage VEP is shifted up (or shifted down) by 0.5 V, the potential VL decreases (or increases) by 15 V. Specifically, the control resolution is 15 V. When the potential VL lies in the first target range, but does not lie in the second target range, shifting the lamp voltage VLP by 0.5 V is successful in surely bringing the potential VL close to the target value $VL_0$ (200 V).

Figure 3A:
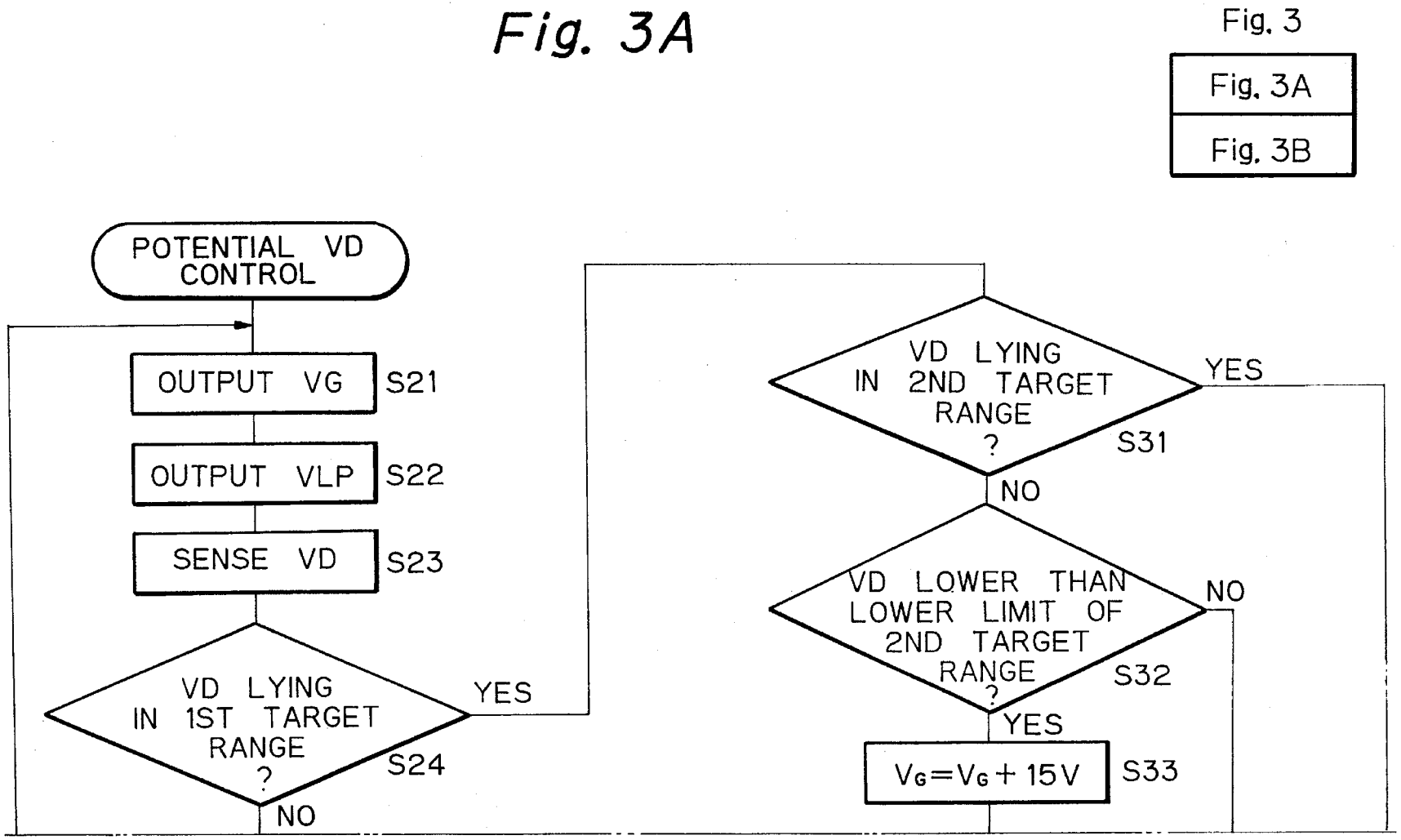
FIG. 3 shows another specific operation of the embodiment for adjusting a grid voltage in such a manner as to confine the potential of a dark portion in a predetermined range.
Figure 3B:
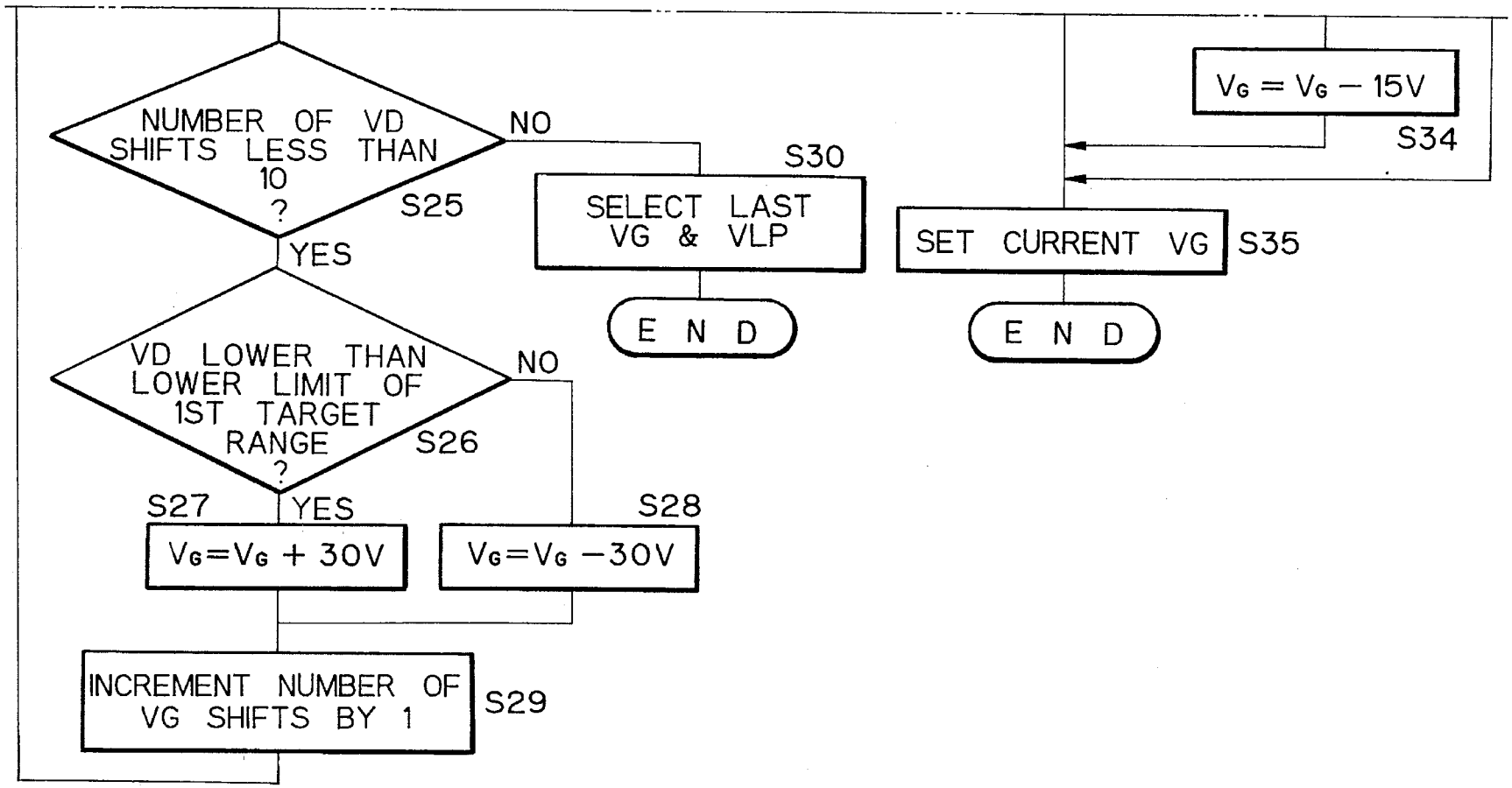

Referring to FIG. 3, there will be described a procedure for controlling the grid voltage VG such that the potential VD of a dark portion is confined in a predetermined range represented by the target value $VD_0\pm$ tolerance width $\Delta VD_2$. In a first control stage, the charger 2 and the lamp 11 are respectively turned on by the grid voltage VG having a certain value (usually, a control value used last time) and the lamp voltage VLP set by the above-described VL control. In this condition, a latent image representative of the other document 18 is formed on the drum 1 (steps S21 and S22). The potential sensor 4 senses the potential VD of a dark portion included in the latent image (step S23). Whether or not the potential VD sensed by the sensor 4 lies in a first target range, which is the target value $VL_0\pm$ first tolerance value $\Delta VD_1$ (800±20 V), is determined (step S24). If the answer of the step S24 is negative. N, whether or not the number of times that the grid voltage VG has been shifted is less than an upper limit (ten times) is determined (step S25). If the former is less than the latter (Y, step S25), whether or not the the potential VD is lower than the lower limit (780 V) of the first target range is determined (step S26). If the answer of the step S26 is positive. Y, the grid voltage VG is shifted up by 30 V (step S27); if otherwise, it is shifted down by 30 V (step S28). The updated grid voltage VG is set as a new process condition. Subsequently, the number of shifts of the voltage VG is incremented by 1 (step S29). Then, the program returns to the step S1.

The change ΔVG in the grid voltage VG and the change ΔVD in the potential VD of a dark portion have a relation of ΔVD=ΔVG. Hence, when the grid voltage VG is shifted up (or shifted down) by 30 V, the potential VD increases (or decreases) by 30 V. In this sense, the control resolution is 30 V which is great enough to confine the potential VD in the first target range in a short time and is smaller than the first tolerance width $\Delta VD_1$ (±20=40 V) to eliminate jitter.

The control loop stated above is repeated thereafter. When the number of shifts of the grid voltage VG exceeds ten times (N, step S25), it is determined that an error has occurred in the VD control. Then, the process conditions (VG and VLP) set up by the last control are again set up as new process conditions. (step S30).

When the potential VD lies in the first target range (Y, step S24), the program enters into a second control stage. Specifically, whether or not the potential VD lies in a second target range represented by the target value $VD_0\pm$ second tolerance value $\Delta VD_2$ (800±10 V) is determined (step S31). If the answer of the step S31 is positive, Y, the grid voltage VG applied this time is used as a new process condition (step S35). If the answer of the step S31 is negative, N, whether or not the potential VD is lower than the lower limit (790 V) of the second target range is determined (step S32). If the former is lower than the latter (Y, step S32), the grid voltage VG is shifted up by 15 V (step S33); if otherwise, it is shifted down by 15 V (step S34). The updated grid voltage VG is set as a new process condition.

From the relation $\Delta VD=\Delta VG$, it follows that when the grid voltage VG is shifted up (or shifted down) by 15 V, the potential VD increases (or decreases) by 15 V, meaning that the control resolution is 15 V. When the potential VD lies in the first target range, but does not lie in the second target range, shifting the grid voltage VG by 15 V is successful in surely bringing the potential VD close to the target voltage $VD_0$ (800 V).

As stated above, the lamp voltage VLP and grid voltage VG are respectively adjusted such that the potentials VL and VD of the drum I converge to their comparatively broad first tolerance widths ($\pm\Delta VL_1$=20 V and $\pm\Delta VD_1$=20 V) of the target values ($VL_0$=200 V and $VD_0$=800 V) in a short time, and then to the comparatively narrow second tolerance widths ($\pm\Delta VL_2$=10 V and $\pm\Delta VD_2$ =10 V) for the final control accuracy. Hence, the embodiment is capable of controlling the process conditions rapidly and accurately.

Another advantage is achievable due to the fact that the lamp voltage VLP is adjusted such that the potential VL of the drum 1 converges to the second tolerance width ($\pm\Delta VL_2=\pm10$ V) of the target value ($VL_0$=200 V)) rapidly, as follows. Even when the potential VL fluctuates due to the tall of the sensitivity of the drum 1 or the contamination of a lens and mirrors included in the optics, it is returned to the predetermined range rapidly without affecting the other potential VD of the drum 1, thereby freeing images from contamination.

Adjusting the grid voltage VG such that the potential VD of the drum 1 converges to the second tolerance width ($\pm\Delta VD_2=\pm10$ V) of the target value ($VD_0$=800 V) in a short time is also advantageous in the following respect. Even when the potential VD fluctuates due to the aging of the drum 1, it is returned to the predetermined range in a short time without affecting the potential VL of the latent image, thereby preventing a solid image having a substantial area from being lowered in density.

The control resolution for the first control stage has a comparatively great value (30 V), as stated earlier. This allows the two potentials VL and VD to approach their target values ($VL_0$ and $VD_0$)rapidly. On the other hand, the control resolution for the second control stage has a comparatively small value (15 V), causing the potentials VL and VD to approach the respective target values with higher accuracy. As a result, the process conditions are controlled more rapidly with accuracy.

The resolutions for the first control stage (30 V) are lower than the first tolerance width (40 V), while the resolutions for the second control stage (15 V) are lower than the second tolerance width (20 V), as stated previously. In this condition, the potentials VL and VD surely converge to the respective target values ($VL_0$=200 V and $VD_0$=800 V). This eliminates an occurrence that the sensed potentials VL and VL jitter in the vicinity of the respective target values and do not converge, and an occurrence that a long period of time is necessary for them to converge.

While the embodiment has been shown and described as adjusting the lamp voltage VLP and grid voltage VG, it may alternatively adjust, for example, a voltage to be applied to a corona wire included in the charger 2.

In the embodiment, the potentials VL and VD of a light portion and a dark portion, respectively, of the drum 1 are used as control parameters particular to an image forming process. If desired. VL and VD may be replaced with the density of a toner image formed on the drum 1, e.g., the amount of toner forming a toner image representative of a reference pattern formed on the drum 1. Then, the amount of toner deposition will be electrically, optically or otherwise detected, and process conditions (e.g. toner concentration and bias voltage for development) will be adjusted to lie in their predetermined ranges.

Furthermore, the embodiment senses the potentials VL and VD of the drum 1 (control parameters), and adjusts the lamp voltage VLP and grid voltage VG (process conditions) such that VL and VD lie in their predetermined ranges. Alternatively, process conditions which are not directly related to the control parameters, e.g., a bias voltage for a developing roller included in the developing unit 5 and a bias voltage for an image transfer unit may be controlled.

In summary, it will be seen that the present invention provides a method and an apparatus for controlling process conditions for image formation which achieve various unprecedented advantages, as enumerated below.

(1) Process conditions. e.g., a voltage for a charger and a voltage for a light source are respectively adjusted such that control parameters, e.g., surface potentials of an image carrier (light portion and dark portion) are confined in their comparatively broad first tolerance widths of target values in a short time, and then in comparatively narrow second tolerance widths for the final control accuracy. Hence, the present invention is capable of controlling the process conditions rapidly and accurately.

(2) The voltage for the light source is adjusted such that the potential of a light portion of a latent image formed on the image carrier converges to the second tolerance width of the target value rapidly. Hence, even when the potential fluctuates due to the fall of the sensitivity of the image carrier or the contamination of a lens and mirrors included in optics, it is returned to the predetermined range in a short time without affecting the potential of a dark portion of the latent image, thereby freeing images from contamination.

(3) Adjusting the voltage for the charger, e.g, grid voltage such that the potential of the dark portion converges to the second tolerance width of the target value in a short time is also advantageous in the following respect. Even when the potential of the dark portion fluctuates due to the aging of the image carrier, it is returned to the predetermined range in a short time without affecting the potential of the light portion, thereby preventing a solid image having a substantial area from being lowered in density.

(4) A control resolution for a first control stage has a comparatively great value, so that the control parameters can approach their target values rapidly. On the other hand, a control resolution for a second control stage has a comparatively small value, causing the parameters to approach the respective target values with higher accuracy. As a result, the process conditions are controlled more rapidly with accuracy.

(5) The resolutions for the first and second control stages are lower than the first and second tolerance widths, respectively. In this condition, the control parameters surely converge to the respective target values. This eliminates an occurrence that the control parameters jitter in the vicinity of the respective target values and do not converge, and an occurrence that a long period of time is necessary for them to converge.

Various modifications will become possible for those skilled in the art after receiving the teachings of the present disclosure without departing from the scope thereof.

What is claimed is:

1. A method of controlling a process condition for image formation on the basis of a sensed value of a control parameter particular to image formation, said method comprising the steps of:

(a) adjusting the process condition such that the sensed value of the control parameter lies in a first predetermined tolerance width of a target value; and (b) adjusting, after step (a), the process condition such that the sensed value of the control parameter lies in a second predetermined tolerance width of said target value which is narrower than said first tolerance width.

2. A method as claimed in claim 1, wherein the control parameter comprises a potential of a light portion of a latent image electrostatically formed on an image carrier, and the process condition comprises a voltage to be applied to a light source for exposure.

3. A method as claimed in claim 1, wherein the control parameter comprises a potential of a dark portion of a latent image electrostatically formed on an image carrier, and the process condition comprises a voltage to be applied to a charger.

4. A method as claimed in claim 1, wherein a control resolution for step (b) is greater than a control resolution for step (a).

5. A method as claimed in claim 1, wherein a control resolution for step (a) and a control resolution for step (b) are smaller than said first tolerance width and said second tolerance width, respectively.

6. An apparatus for controlling a process condition for image formation, comprising:

sensing means for sensing a control parameter particular to an image forming process; and control means for controlling a process condition for image formation on the basis of the control parameter sensed by said sensing means;

said control means comprising:

first control means for adjusting the process condition such that the control parameter sensed by said sensing means lies in a first predetermined tolerance width of a target value;

determining means for determining whether the control parameter lies within the first predetermined tolerance width; and second control means for adjusting, when the control parameter has entered the first predetermined tolerance width as determined by the determining means, the process condition such that the control parameter sensed by said sensing means lies in a second predetermined tolerance width of the target value which is narrower than said first tolerance width.

7. An apparatus as claimed in claim 6, wherein the control parameter comprises a potential of a light portion of a latent image electrostatically formed on an image carrier, and the process condition comprises a voltage to be applied to a light source for exposure.

8. An apparatus as claimed in claim 6, wherein the control parameter comprises a potential of a dark portion of a latent image electrostatically formed on an image carrier, and the process condition comprises a voltage to be applied to a charger.

9. An apparatus as claimed in claim 6, wherein a control resolution assigned to said second control means is greater than a control resolution assigned to said first control means.

10. An apparatus as claimed in claim 6, wherein a control resolution assigned to said first control means and a control resolution assigned to said second control means are smaller than said first tolerance width and said second tolerance width, respectively.

11. An apparatus for controlling a process condition for image formation, comprising:

sensing means for sensing a control parameter particular to an image forming process; and control means for controlling a process condition for image formation on the basis of the control parameter sensed by said sensing means;

said control means comprising:

first control means for adjusting the process condition such that the control parameter sensed by said sensing means lies in a first predetermined tolerance width of a target value; and second control means for adjusting the process condition such that the control parameter sensed by said sensing means lies in a second predetermined tolerance width of the target value which is narrower than said first tolerance width, wherein the control parameter comprises a potential of a light portion of a latent image electrostatically formed on an image carrier and the process condition comprises a voltage to be applied to a light source for exposure.

12. An apparatus for controlling a process condition for image formation, comprising:

sensing means for sensing a control parameter particular to an image forming process; and control means for controlling a process condition for image formation on the basis of the control parameter sensed by said sensing means;

said control means comprising:

first control means for adjusting the process condition such that the control parameter sensed by said sensing means lies in a first predetermined tolerance width of a target value; and second control means for adjusting the process condition such that the control parameter sensed by said sensing means lies in a second predetermined tolerance width of the target value which is narrower than said first tolerance width, wherein the control parameter comprises a potential of a dark portion of a latent image electrostatically formed on an image carrier, and the process condition comprises a voltage to be applied to a charger.

13. An apparatus for controlling a process condition for image formation, comprising:

sensing means for sensing a control parameter particular to an image forming process; and control means for controlling a process condition for image formation on the basis of the control parameter sensed by said sensing means;

said control means comprising:

first control means for adjusting the process condition such that the control parameter sensed by said sensing means lies in a first predetermined tolerance width of a target value; and second control means for adjusting the process condition such that the control parameter sensed by said sensing means lies in a second predetermined tolerance width of the target value which is narrower than said first tolerance width, wherein a control resolution assigned to said second control means is greater than a control resolution assigned to said first control means.

14. An apparatus for controlling a process condition for image formation, comprising:

sensing means for sensing a control parameter particular to an image forming process; and control means for controlling a process condition for image formation on the basis of the control parameter sensed by said sensing means;

said control means comprising:

first control means for adjusting the process condition such that the control parameter sensed by said sensing means lies in a first predetermined tolerance width of a target value; and second control means for adjusting the process condition such that the control parameter sensed by said sensing means lies in a second predetermined tolerance width of the target value which is narrower than said first tolerance width, wherein a control resolution assigned to said first control means and a control resolution assigned to said second control means are smaller than said first tolerance width and said second tolerance width, respectively.

15. An apparatus for controlling a process condition for image formation, comprising:

a sensor which senses a control parameter particular to an image forming process; and a controller which controls a process condition for image formation on the basis of the control parameter sensed by said sensor;

said controller comprising:

a first control portion which adjusts the process condition such that the control parameter sensed by said sensor lies in a first predetermined tolerance width of a target value;

a device which determines whether the control parameter lies within the first predetermined tolerance width; and a second control portion which adjusts when the control parameter has entered the first predetermined tolerance width as determined by the device which determines the process condition such that the control parameter sensed by said sensor lies in a second predetermined tolerance width of the target value which is narrower than said first tolerance width.

16. An apparatus as claimed in claim 15, wherein the control parameter comprises a potential of a light portion of a latent image electrostatically formed on an image carrier, and the process condition comprises a voltage to be applied to a light source for exposure.

17. An apparatus as claimed in claim 15, wherein the control parameter comprises a potential of a dark portion of a latent image electrostatically formed on an image carrier, and the process condition comprises a voltage to be applied to a charger.

18. An apparatus as claimed in claim 15, wherein a control resolution assigned to said second control portion is greater than a control resolution assigned to said first control portion.

19. A method as claimed in claim 15, wherein a control resolution assigned to said first control portion and a control resolution assigned to said second control portion are smaller than said first tolerance width and said second tolerance width, respectively.

* * * * *